US007900646B2

(12) United States Patent
Miller

(10) Patent No.: US 7,900,646 B2
(45) Date of Patent: Mar. 8, 2011

(54) COLLAPSIBLE SUPPORT STRUCTURE

(76) Inventor: Stephen F. Miller, Laguna Beach, CA (US)

( * ) Notice: Subject to any disclaimer, the term of this patent is extended or adjusted under 35 U.S.C. 154(b) by 0 days.

(21) Appl. No.: 12/309,504

(22) PCT Filed: Jul. 16, 2007

(86) PCT No.: PCT/US2007/073601

§ 371 (c)(1),
(2), (4) Date: Oct. 5, 2009

(87) PCT Pub. No.: WO2008/011375

PCT Pub. Date: Jan. 24, 2008

(65) Prior Publication Data

US 2010/0037930 A1 Feb. 18, 2010

Related U.S. Application Data

(60) Provisional application No. 60/831,884, filed on Jul. 19, 2006.

(51) Int. Cl.
*E04H 15/48* (2006.01)
*E04B 1/32* (2006.01)

(52) U.S. Cl. ..... 135/130; 135/127; 135/123; 135/120.3; 135/144; 52/81.3; 52/645

(58) Field of Classification Search ..... 135/121, 135/123, 124, 127, 120.3, 143–144, 907; 52/81.1, 81.5, 83, 641, 646–647, 650.2; 446/116, 446/119

See application file for complete search history.

(56) References Cited

U.S. PATENT DOCUMENTS

| | | | | | |
|---|---|---|---|---|---|
| 1,546,222 | A * | 7/1925 | Finlay | 135/157 |
| 3,059,658 | A * | 10/1962 | Finlayson | 135/147 |
| 3,502,091 | A * | 3/1970 | Corbin | 135/97 |
| 3,710,806 | A * | 1/1973 | Kelly et al. | 135/145 |
| 3,771,274 | A * | 11/1973 | Vaughan | 52/646 |
| 3,810,482 | A * | 5/1974 | Beavers | 135/147 |
| 4,393,887 | A * | 7/1983 | Orribin | 135/153 |
| 4,614,502 | A * | 9/1986 | Nelson | 446/119 |
| 4,876,831 | A * | 10/1989 | Runyon | 52/70 |
| 4,944,322 | A * | 7/1990 | Gillis | 135/153 |
| 5,165,207 | A * | 11/1992 | Oehlke | 52/81.3 |
| 5,361,794 | A * | 11/1994 | Brady | 135/147 |
| 5,423,341 | A * | 6/1995 | Brady | 135/139 |
| 6,679,644 | B1 * | 1/2004 | Heller | 403/220 |
| 6,748,962 | B2 * | 6/2004 | Miller | 135/130 |

FOREIGN PATENT DOCUMENTS

JP 09166286 A * 6/1997

* cited by examiner

*Primary Examiner* — Winnie Yip
(74) *Attorney, Agent, or Firm* — John J. Connors; Connors & Assoc.

(57) ABSTRACT

A collapsible support structure comprises a plurality of interconnected substantially triangular frame sections connected by flexible joints at corners thereof. At least some of the interconnected frame sections share a collapsible tubular member as one side of the interconnected triangular frame sections and at least some of the ends of rigid tubular members of the interconnected frame sections are disposed between adjacent shared collapsible tubular members. An elongated flexible tensioning member extends through the shared collapsible tubular members and between the ends of the rigid tubular members disposed between adjacent shared collapsible tubular members. The rigid tubular members of some of the interconnected frame sections form a frame roof with ends thereof tied to form a flexible joint at the apex frame roof.

18 Claims, 8 Drawing Sheets

COLLAPSIBLE SUPPORT STRUCTURE

RELATED PATENT APPLICATIONS & INCORPORATION BY REFERENCE

This application is a PCT application which claims the benefit under 35 USC 119(e) of U.S. Provisional Patent Application No. 60/831,884, entitled "COLLAPSIBLE SUPPORT STRUCTURE," filed Jul. 19, 2006. This related application is incorporated herein by reference and made a part of this application. If any conflict arises between the disclosure of the invention in this PCT application and that in the related provisional application, the disclosure in this PCT application shall govern. Moreover, the inventor incorporates herein by reference any and all U.S. patents, U.S. patent applications, and other documents, hard copy or electronic, cited or referred to in this application, including U.S. Pat. No. 6,748,962 and pending U.S. Ser. No. 10/726,003, filed Nov. 12, 2003.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

BACKGROUND

U.S. Pat. No. 6,748,962 discloses a collapsible support structure of the inventor's. The invention disclosed herein is an improvement in this collapsible support structure.

SUMMARY

My collapsible support structure has one or more of the features depicted in the embodiments discussed in the section entitled "DETAILED DESCRIPTION OF SOME ILLUSTRATIVE EMBODIMENTS." The claims that follow define my collapsible support structure, distinguishing it from the prior art; however, without limiting the scope of my collapsible support structure as expressed by these claims, in general terms, some, but not necessarily all, of its features are:

One, my collapsible support structure includes a plurality substantially triangular frame sections each having corners connected by flexible joints. Each frame section has a pair of elongated rigid tubular members having at opposed ends a pair of openings adjacent the ends of the tubular members. The rigid tubular members may be one-piece. The individual openings of each pair of openings may be in substantial alignment. Each frame section also includes a collapsible elongated tubular member having a rigid state and a collapsed state, so the support structure is foldable when the collapsible member is collapsed. An elongated flexible tensioning member passing through the tubular members forms the flexible joints interconnecting adjacent frame sections. The frame sections may be interconnected to form a portion of a geodesic structure, a portion of a truncated icosahedron, or other geometrical three-dimensional structures. Some of the ends of the rigid tubular members and the collapsible tubular members may be beveled.

Two, at least some of the interconnected frame sections may share the collapsible tubular member thereof as one side of the interconnected triangular frame sections and at least some of the ends of the rigid tubular members may be disposed between adjacent shared collapsible tubular members of the interconnected frame sections. The elongated flexible tensioning member may extend through the shared collapsible tubular members and outward from the opposed open ends thereof and through the pair of openings in the ends of the rigid tubular members disposed between adjacent shared collapsible tubular members of the interconnected frame sections.

Three, my collapsible support structure may include a frame roof formed from a predetermined number of the frame sections. The frame roof may include a flexible line passing through the pairs of openings in tubular members forming the frame roof to provide a flexible joint at an apex. This enables the frame roof to fold inward without untying the flexible line when the collapsible tubular members are collapsed. A substantially annular configured connector member may be used through which the flexible line is wound and past through openings of the pairs in ends of the tubular members nearby the apex.

Four, my collapsible support structure may also include a frame sidewall formed from a predetermined number of the frame sections. The sidewall may have a top segment including the collapsible tubular member of each frame section forming the frame roof and a bottom segment including the collapsible tubular member of alternate frame sections forming the frame sidewall. The collapsible tubular members of each frame section forming the frame roof and frame sidewall may be oriented from end to end and through which extends the elongated flexible tensioning member.

Five, the flexible tensioning member is within the collapsible elongated tubular members of each triangular frame section, extending outward from their opposed open ends and through the openings in the ends of an adjacent rigid tubular member, and into and through a collapsible elongated tubular member of an adjacent frame section. The elongated flexible tensioning member may have opposed ends that are tied, one of which normally remains tied and one of which is untied and loosened when the support structure is an upright state to collapse the support structure. A portion of the tensioning member may include a pair of knots straddling outer extremities of collapsible elongated tubular member so a pair of axially aligned rigidizing tubular members of the collapsible member do not move a substantial distance laterally along the tensioning member upon the collapse of the collapsible elongated tubular.

These features are not listed in any rank order nor is this list intended to be exhaustive.

DESCRIPTION OF THE DRAWING

Some embodiments of my collapsible support structure are discussed in detail in connection with the accompanying drawing, which is for illustrative purposes only. This drawing includes the following figures (Figs.), with like numerals indicating like parts.

DETAILED DESCRIPTION OF SOME ILLUSTRATIVE EMBODIMENTS

Figure 1:
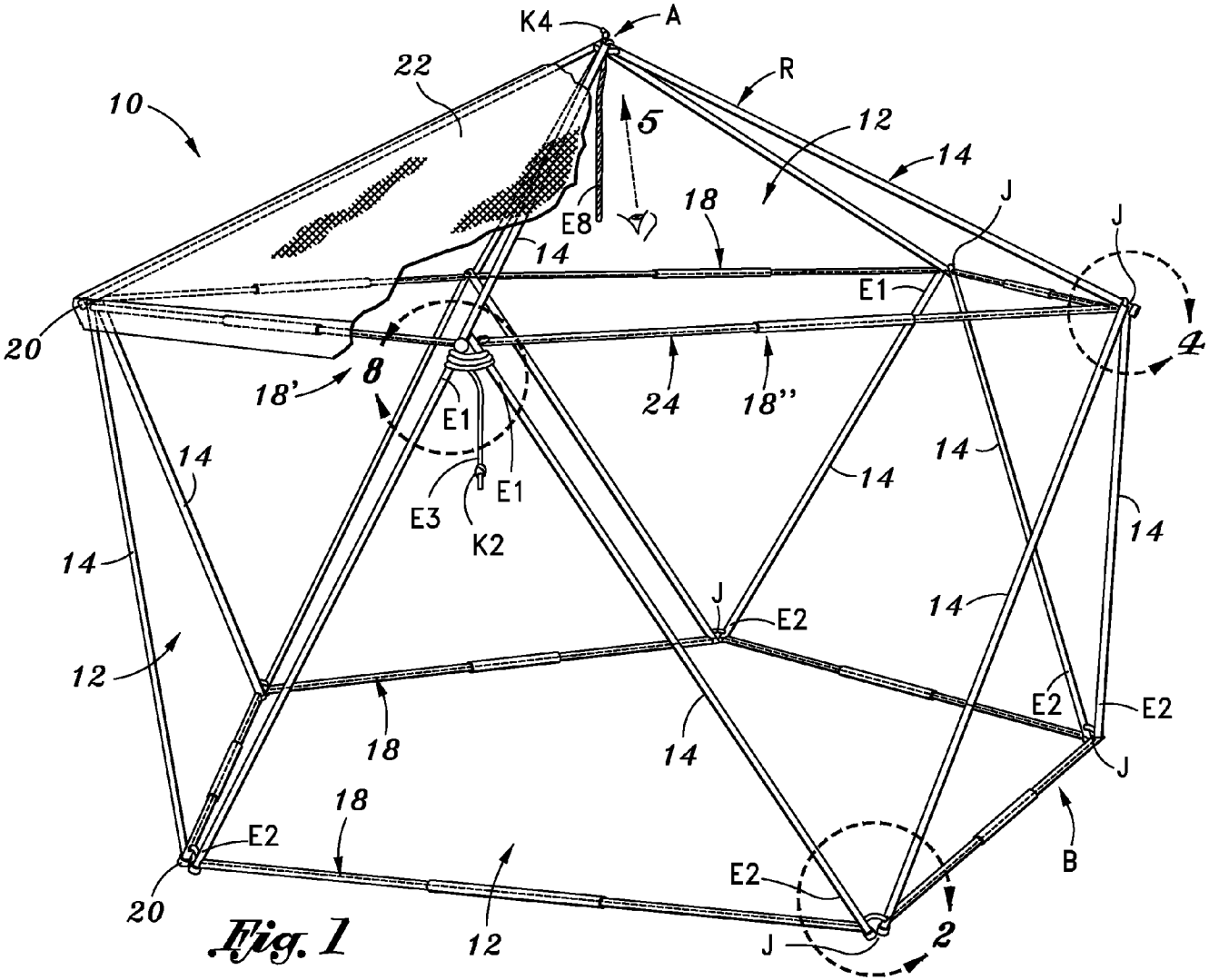
FIG. 1 is a perspective view of one embodiment of the collapsible support structure of this invention.
Figure 11:
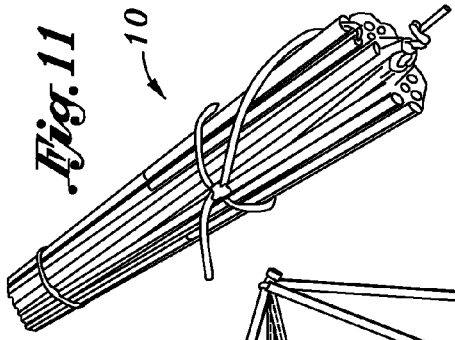
FIG. 11 is a perspective view showing the collapsible support structure depicted in FIG. 1 in a completely collapsed state and folded into a compact assembly.
Figure 10:
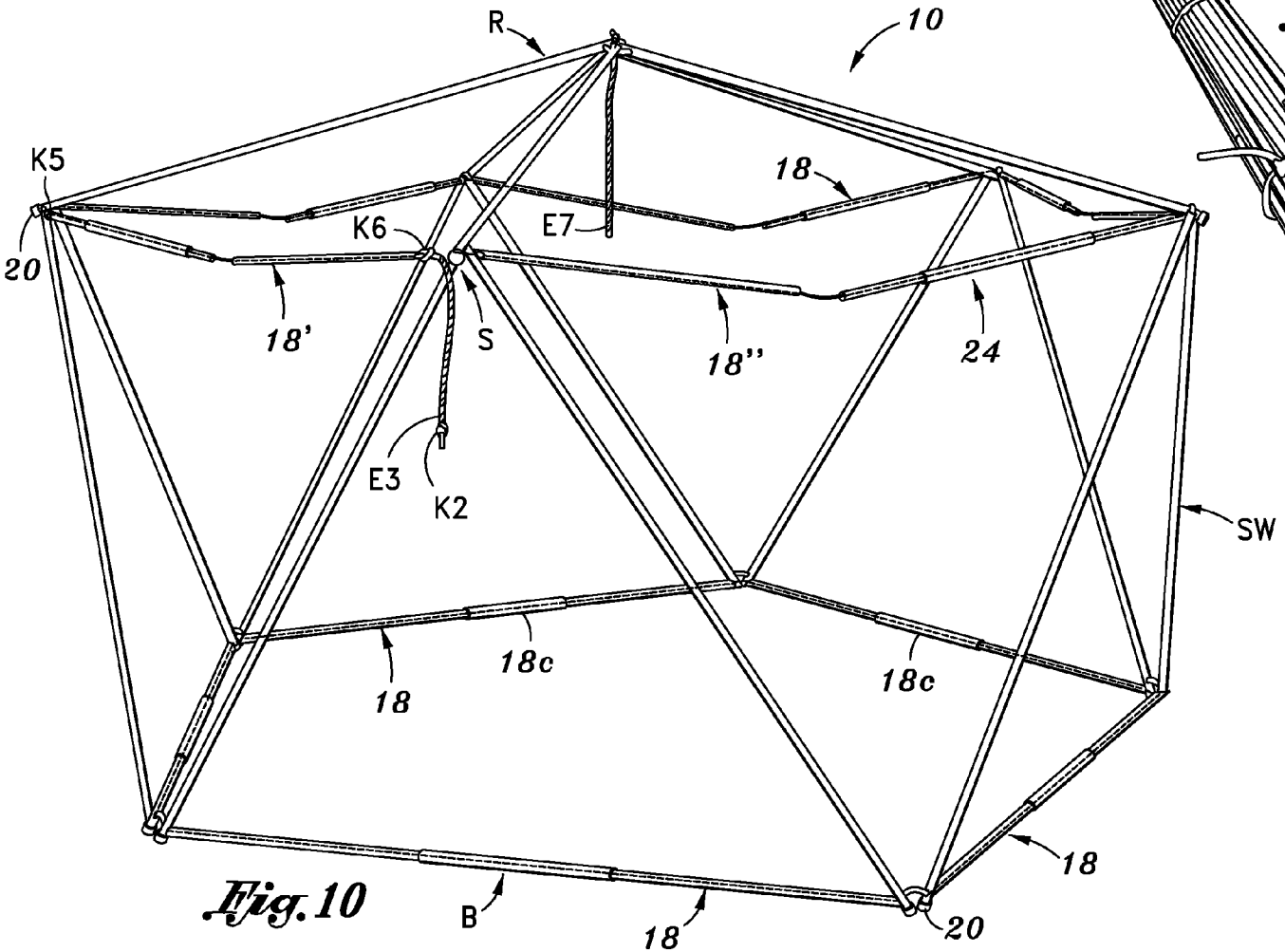
FIG. 10 is a perspective view of the collapsible support structure depicted in FIG. 1 in a partially collapsed state.

One embodiment of the collapsible support structure of this invention is identified by the numeral 10. This collapsible support structure 10 has an upright state shown in FIG. 1, a collapsed state shown in FIG. 11, and a partially collapsed state is shown in FIG. 10. The collapsible support structure 10 comprises a plurality of interconnected substantially triangular frame sections 12, each having corners connected by flexible joints J (FIG. 1). Some of the interconnected frame sections 12 form a frame roof R and others form a frame sidewall SW (FIG. 10). Each frame section 12 includes a pair of rigid tubular members 14 and a collapsible tubular member 18 having a rigid state and a collapsed state. The tubular members 14 and 18 may be hollow cylinders made, for example, of a metal such as aluminum or steel having an outside diameter of substantially from ½ to 2 inches, and a length substantially from 3 to 15 feet. The support structure 10 is foldable into a compact assembly, as shown in FIG. 11, when the collapsible tubular members 18 are collapsed and all the tubular members 14 and 18 are folded inward.

The frame sections 12 are essentially equilateral triangles. The rigid members 14 and the collapsible members 18 of each frame section 12 are joined at the flexible joints J (FIGS. 1 and 2) by an elongated tensioning member 26 along a junction 24 or an elongated tensioning member 26' along a base B (FIGS. 2 and 3), as the case may be. The tensioning members 26 and 26' may be, for example, a cord, cable, rope, etc. The elongated tensioning members 26 and 26' passes through axially aligned collapsible members 18. Portions of the tensioning members 26 and 26' passing from one triangular frame sections 12 to an adjacent frame section at the corners form the flexible joints J, which act as a hinge. Consequently, no other mechanism is required to form the hinges or joints J. Thus, the tensioning members 26 and 26' serve the dual function of connecting the triangular frame sections 12 at corners and of acting as hinges at the corners upon collapse of the collapsible support structure 10.

Figure 2:
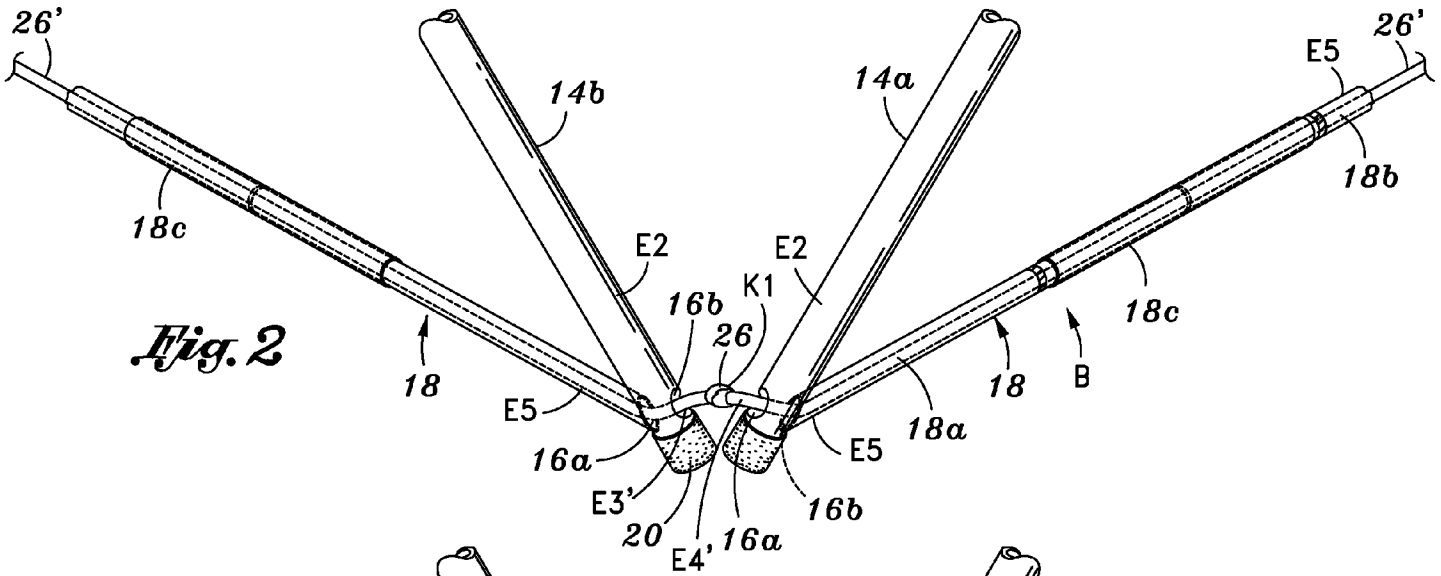
FIG. 2 is an enlarged fragmentary perspective view taken along line 2 of FIG. 1.
Figure 3:
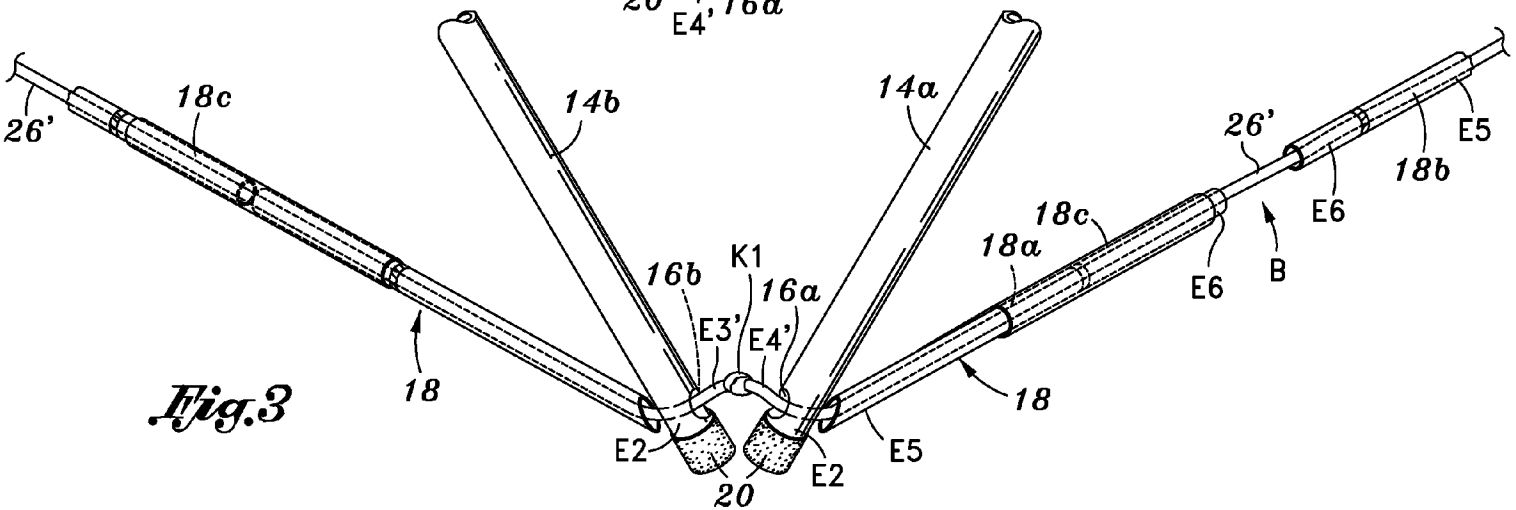
FIG. 3 is an enlarged fragmentary perspective view similar to that of FIG. 1 showing a collapsible tubular member about to be collapsed.
Figures 4, 4A:
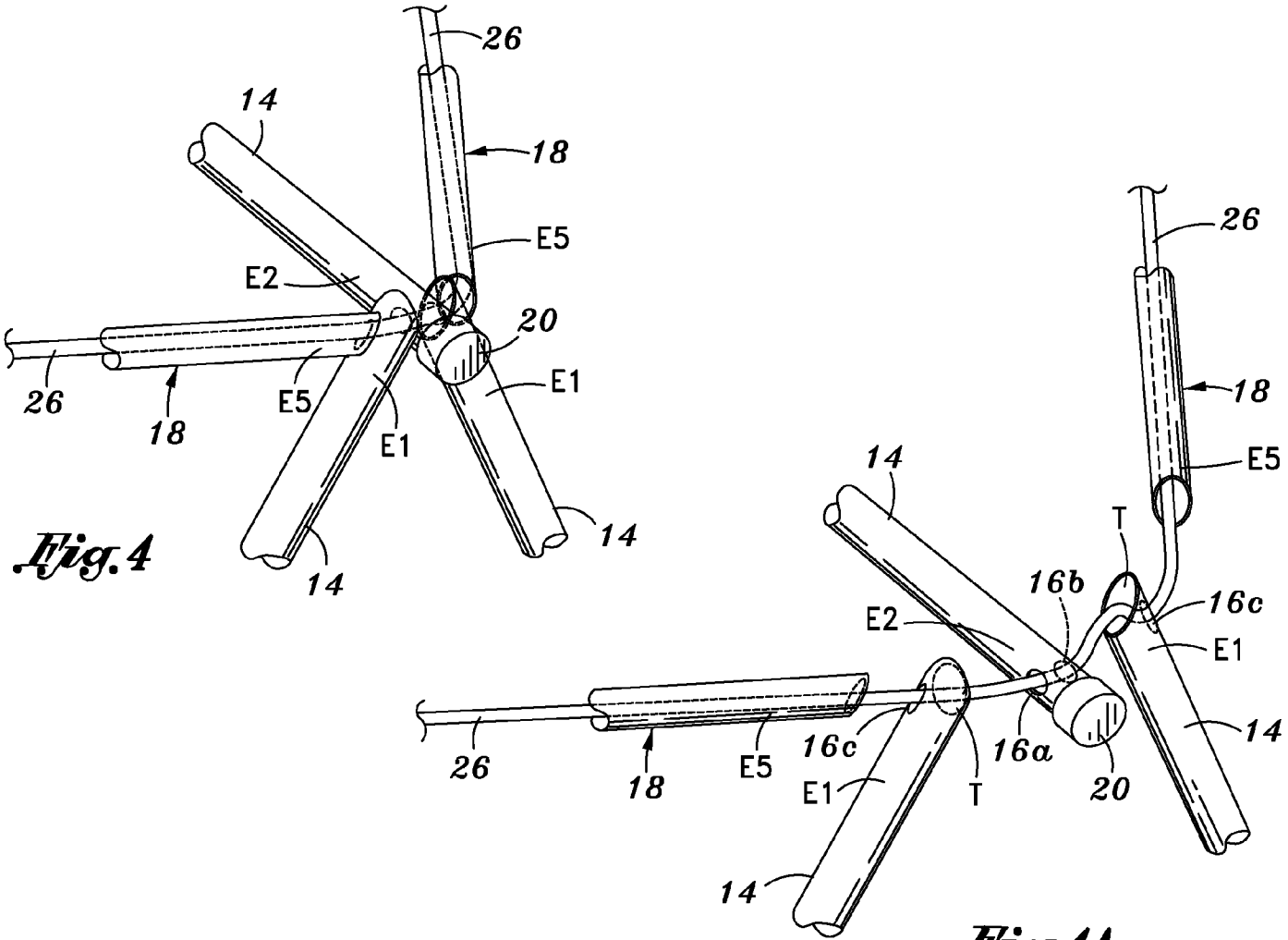
FIG. 4 is an enlarged fragmentary perspective view taken along line 4 of FIG. 1 showing one corner of the collapsible support structure of this invention.
FIG. 4A is an enlarged fragmentary perspective view similar to that of FIG. 4 showing the corner in a collapsed state.

All the rigid tubular sidewall members 14 are essentially identical, and each has an upper end E1 and a lower end E2. Each upper end E1 has an open terminal tip T and is beveled, and each upper end has a single opening 16*c* (FIG. 4A) in a sidewall of the tubular member 14 adjacent the open terminal tip T. Thus, as illustrated in FIGS. 4 and 4A, a line such as, for example, the flexible tensioning member 26, may pass through the opening 16*c* and another opening formed by the open terminal tip T. In the lower ends E2 there are a pair of substantially aligned openings 16*a* and 16*b* adjacent these ends E2 (FIGS. 2 and 3). The ends E2 may be covered by a cap 20 that may, for example, be made of a plastic. The cap 20 functions as a guard minimizing any damage to a tent awning 22 (FIG. 1) supported by the support structure 10, or otherwise avoiding injury to a user.

All the collapsible tubular members 18 are essentially identical. As best illustrated in FIGS. 2 and 3, each collapsible tubular member 18 includes a rigidizing sleeve member 18*c* and pair of tubular rigidizing members 18*a* and 18*b* extending along a portion of one elongated flexible tensioning member 26 or 26', as the case may be. As shown in FIG. 2, the rigidizing members 18*a* and 18*b* are essentially axially aligned when the tubular member 18 is in a rigid, non-collapsed state. In this rigid state, an outer open end E5 of the rigidizing members 18*a* and 18*b* bear against an adjacent rigid member 14 and their respective right angle cut inner ends E6 (FIG. 3) abut each other. The tensioning member 26 passes through the hollow interiors of the rigidizing members 18*a* and 18*b* and out opposed outer ends E5 of the rigidizing members 18*a* and 18*b*. The outer ends E5 may be beveled. The rigidizing sleeve member 18*c* is slideably mounted on the rigidizing members 18*a* and 18*b*. The inside diameter of the sleeve member 18*c* is slightly greater than the outside diameters of the rigidizing members 18*a* and 18*b*, which have essentially the same outside diameters. Thus, the sleeve member 18*c* is sized to engage slideably both rigidizing members 18*a* and 18*b* to form the collapsible elongated tubular member 18.

At least some of the interconnected frame sections 12 share as a common one side of their triangular configuration a tubular member 14. Other interconnected frame sections 12 share as a common one side of their triangular configuration a collapsible tubular member 18. The frame roof R and frame sidewall SW meet at a common segment that forms the junction 24. This junction 24 comprises the collapsible tubular members 18 of alternate frame sections 12 forming the frame roof R and frame sidewall SW that are aligned and oriented from end to end (FIGS. 1 and 10). The one elongated flexible tensioning member 26 extends lengthwise through the hollow interiors of each of the collapsible tubular members 18 forming the junction 24, and it has opposed ends E3 and E4 that are tied when the structure 10 is upright as depicted in FIGS. 8 and 9.

As depicted in FIG. 10, the collapsible support structure 10 is collapsed as the rigidizing sleeve members 18*c* are moved laterally to allow the rigidizing members 18*a* and 18*b* to be folded were their ends meet, collapsing the tubular members 18. A bottom segment of the frame sidewall SW forming the base B comprises the collapsible tubular member 18 of alternate frame sections 12 forming the frame sidewall SW. The collapsible tubular members 18 of the base B are aligned and oriented from end to end. As illustrated in FIGS. 2 and 3, the elongated flexible tensioning member 26' extends lengthwise through the hollow interiors of each of the collapsible tubular members 18 forming the base B. The opposed ends E3' and E4' of the tensioning member 26' are tied in a knot K1 and remain so regardless of the upright or collapsed state of the structure 10. The tensioning member 26 extends through each of the collapsible tubular members 18 forming the junction 24 and, as shown in FIG. 9, has its opposed ends E3 and E4 connected in a manner so the end E3 may be disconnected when the collapsible support structure 10 is to be collapsed.

Figures 8, 9:
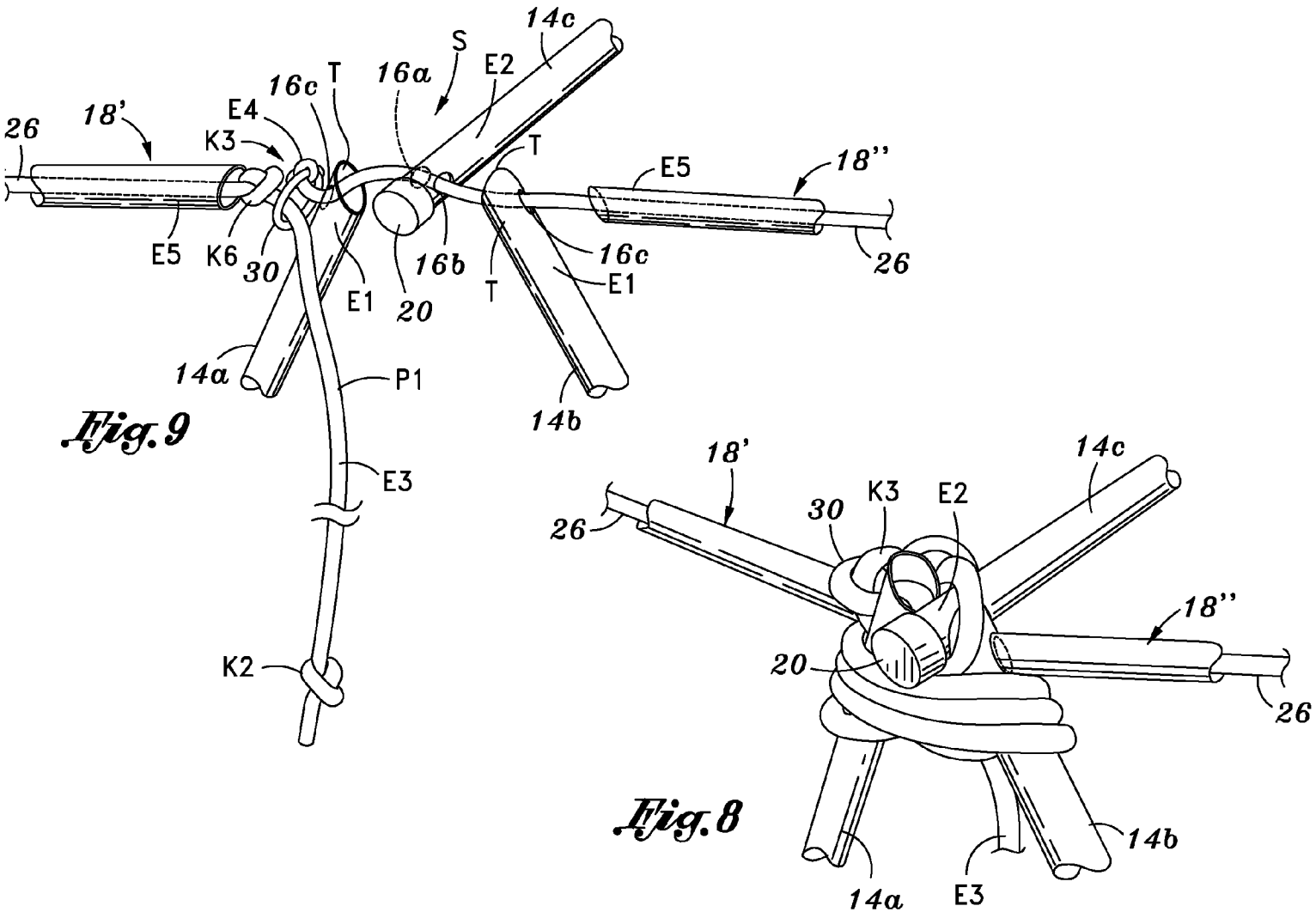
FIG. 8 is an enlarged fragmentary perspective view taken along line 8 of FIG. 1 showing opposed ends of flexible tensioning member tied together.
FIG. 9 is an enlarged fragmentary perspective view similar to that of FIG. 8 showing the opposed ends of flexible tensioning member untied.

Referring to FIGS. 8 and 9, this manner of connecting and disconnecting the ends E3 and E4 of the tensioning member 26 is illustrated. One rigid tubular member identified by the numeral 14*c* of the frame roof R is disposed between the beveled ends E1 of the rigid tubular members respectively identified by the numerals 14*a* and 14*b* of adjacent frame sections 12 forming a portion of the sidewall SW. A portion P1 of tensioning member 26 near the end E3 is secured as shown in FIG. 8 when the support structure 10 is upright (FIG. 1) and unloosened as shown in FIG. 9 to allow the support structure to be folded up as shown in FIG. 11. The portion P1 of tensioning member 26 passes through a ring 30, and an enlarged knot K2 near the tip of the end E3 acts as a stop to prevent the end E3 from passing through the ring 30 when the collapsible support structure 10 is being collapsed.

As depicted in FIG. 9, the adjacent collapsible tubular members identified by the numerals 18' and 18" of the junction 24 provide a space S where the end E4 of the tensioning member 26 is tied to the ring 30 in the knot K3 (FIG. 8). The end E4 remains so tied regardless of the upright or collapsed state of structure 10. As depicted in FIG. 8, when the portion P1 of the tensioning member 26 is wrapped around the rigid tubular members respectively identified by the numerals 14*a* and 14*b* of adjacent frame sections 12 forming the portion of the sidewall SW nearby the space S, the end E3 is tied and secured in position and the collapsible support structure 10 is upright as shown in FIG. 1. This imparts rigidity to the structure 10 because the all the tubular members 18, including members 18' and 18", are aligned with adjacent ends abutting, not allowing the structure to come down on itself until the end E3 is unloosened or untied. Upon unloosening the end E3, the ring 30 slides along the portion P1 until meeting the knot K2 near the end E3, which acts as a stop.

Initially during assembly, neither end E3 or E4 of the tensioning member 26 is tied in any fashion, and the end E4 is fed through the aligned collapsible tubular members 18 and tied to the ring 30. The end E4 is fed through the open beveled end E5 of the collapsible tubular member 18" and past through the opening 16*c* in the rigid member 14*b* and then out the tip T of the open beveled end E1 of the rigid member 14*b*, then through the aligned pair of openings 16*a* and 16*b* in the rigid member 14*c* and into the tip T of the open beveled end E1 of the rigid member 14*a* and out the opening 16*c* in the end E1 of the rigid member 14*a* and finally tied to the ring 30 as the knot K3.

The ring 30 including the knot K3 acts as a stop when the tensioning member 26 is placed in tension. As shown in FIG. 8, when the collapsible support structure 10 is placed in the upright state (FIG. 1), the end E3 is pulled downward through ring 30 and the portion P1 is wound over the tubular member 14*c*, down and around the tubular members 14*a* and 14*b*, and cinched up tightly, wrapping the portion P1 around these abutting members as illustrated in FIG. 8. This holds securely the tensioning member 26 in tension and the portion P1 and the one end E3 of the tensioning member 26 hangs loose in a generally vertical orientation. When the structure 10 is to be collapsed, the end E3 is unwound and the portion P1 is loosened and slid through ring 30 until the knot K2 contacts the ring 30.

Figures 5, 5A:
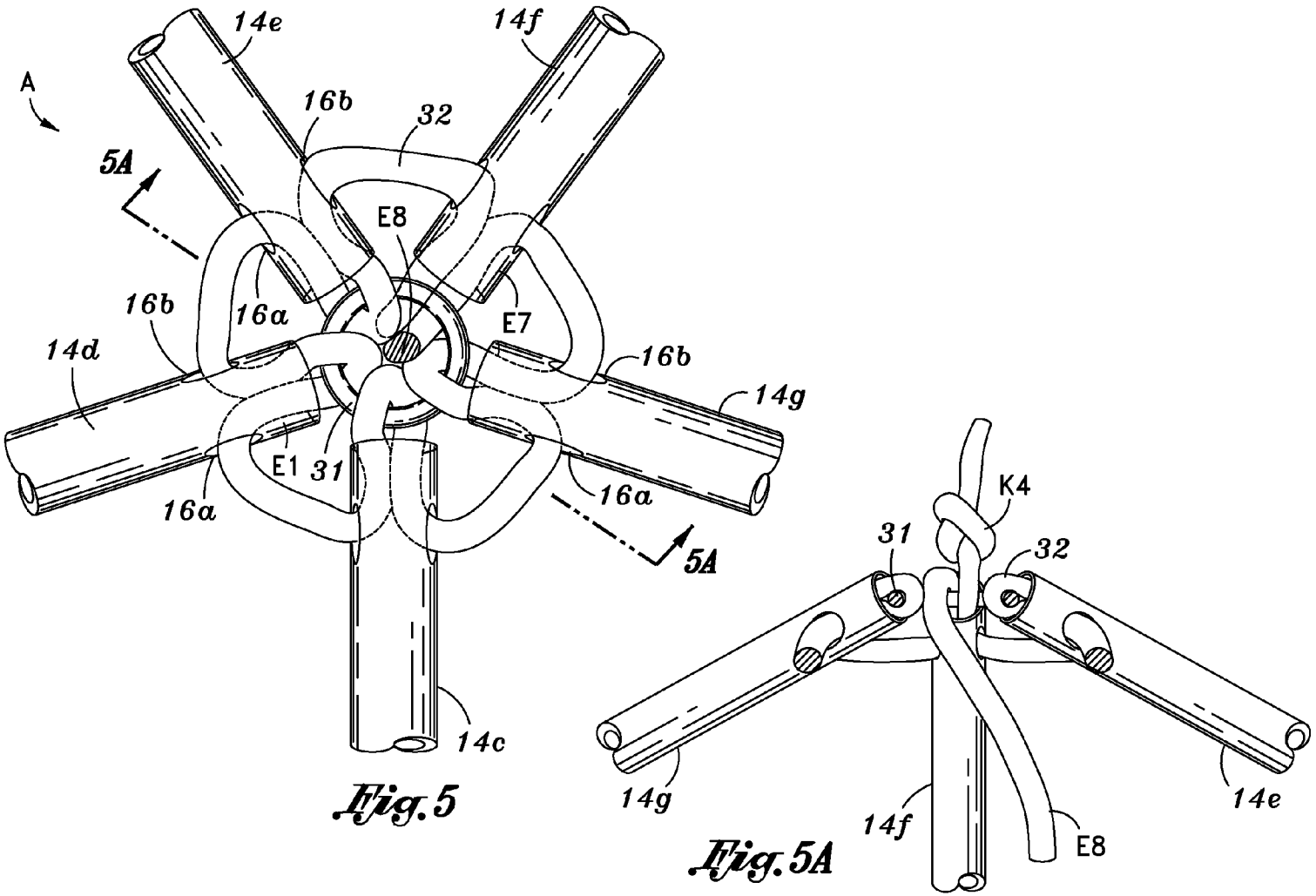
FIG. 5 is a plan view of the underside of the apex of the frame roof of the collapsible support structure shown in FIG. 1.
FIG. 5A is cross-sectional view taken along line 5A-5A of FIG. 5.
Figure 7:
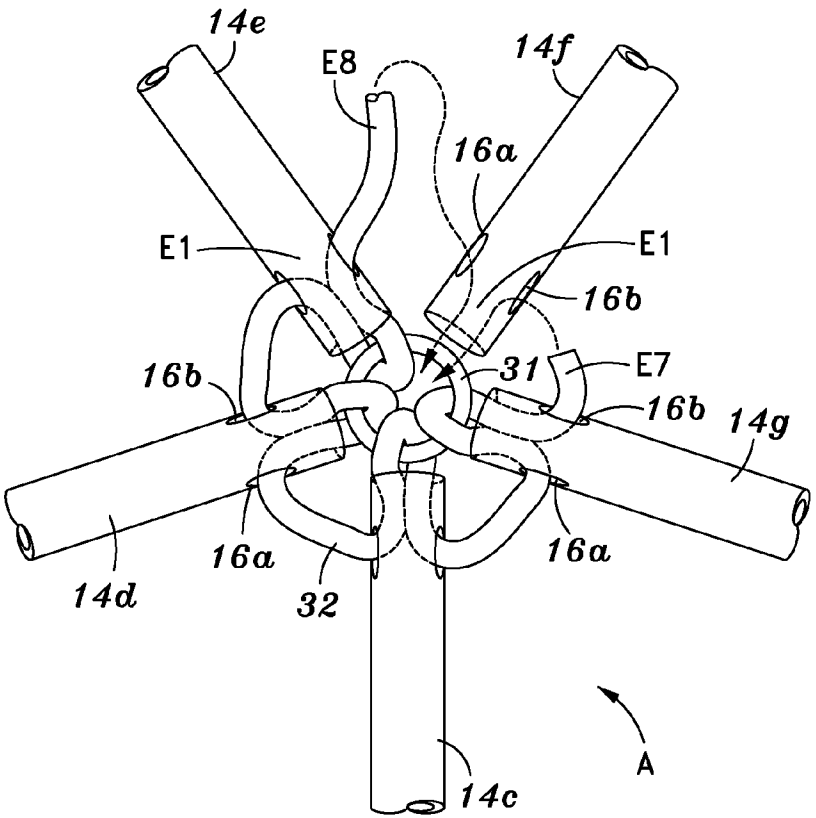
FIG. 7 is a plan view similar to that of FIG. 6 showing the flexible line almost completely threaded through ends of the tubular members forming the apex.
Figure 6:
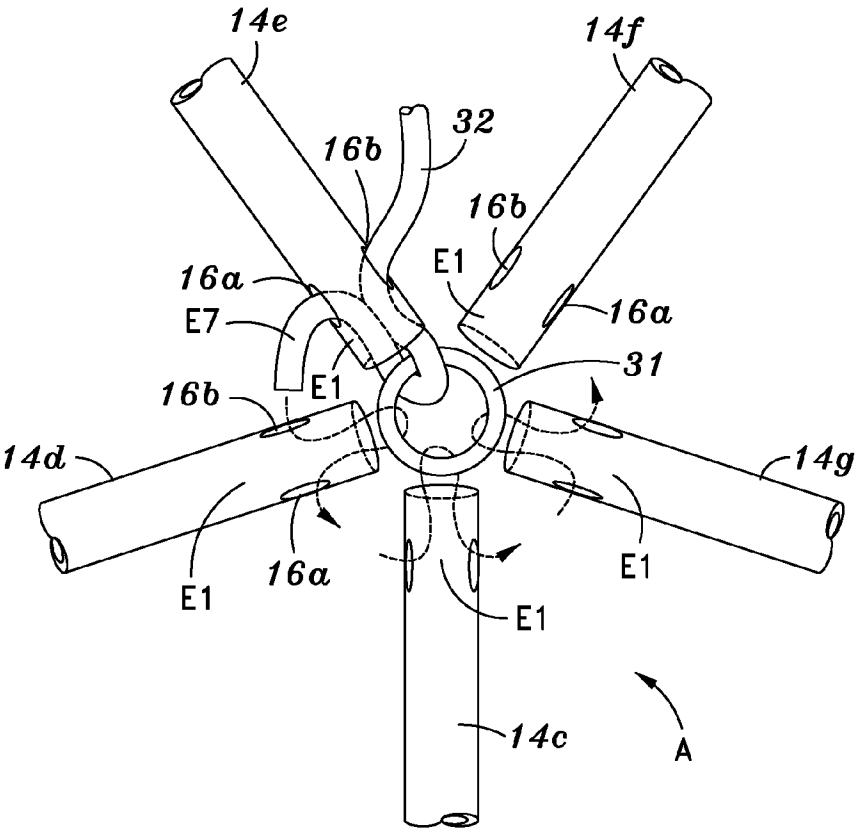
FIG. 6 is a plan view of the underside of the apex similar to that of FIG. 5 showing a flexible line partially threaded through ends of the tubular members forming the apex.

As depicted in FIGS. 5, 6 and 7, the rigid tubular members of the frame sections 12 forming the frame roof R, and identified by the numeral 14*c*, 14*d*, 14*e*, 14*f*, and 14*g*, are essentially identical, being of the same length as the rigid tubular members 14 forming the sidewall SW. Each of the respectively ends E1 of rigid tubular members 14*c*, 14*d*, 14*e*, 14*f*, and 14*g* are not beveled, and are tied together to form an apex A. A connector member 31 having a substantially annular configuration and a flexible line 32 are used to connect these ends E1 together. The line 32 passes through the pair of openings 16*a* and 16*b* and each open end E1 of each tubular member 14*c* through 14*g*, as the case may be, of the frame sections 12 forming the frame roof R to provide a flexible joint or hinge at the apex A. This enables the frame roof R to fold inward (FIG. 10) without untying the flexible line 32 when the collapsible tubular members 18 of the frame sections 12 along the junction 24 are collapsed. The line 32 is sequentially threaded through the ends E1 of the tubular member 14*c* through 14*g* and wrapped around the connector member 31.

For example as depicted in FIG. 6, the one end E7 of the line 32 extends through the one opening 16*b* of the pair of openings 16*a* and 16*b* in the rigid member 14*e*, then through the open end E1 of this rigid tubular member 14*e* and around the connector member 31, and then back through the open end E1 and finally out the other opening 16*a*. This procedure is repeated as illustrated in FIG. 7 until the ends E7 and E8 of the line 32 are respectively threaded through the opening 16*b* and 16*a* of the rigid member 14*f* and out its open end E1. The end E7 is passed under the connector member 31 and out the top of the apex A and tied into a knot K4 (FIGS. 1 and 5A). The end E8 is passed over and around the connector member 31, hanging loose out the bottom of the apex A in a vertical orientation.

Figure 1A:
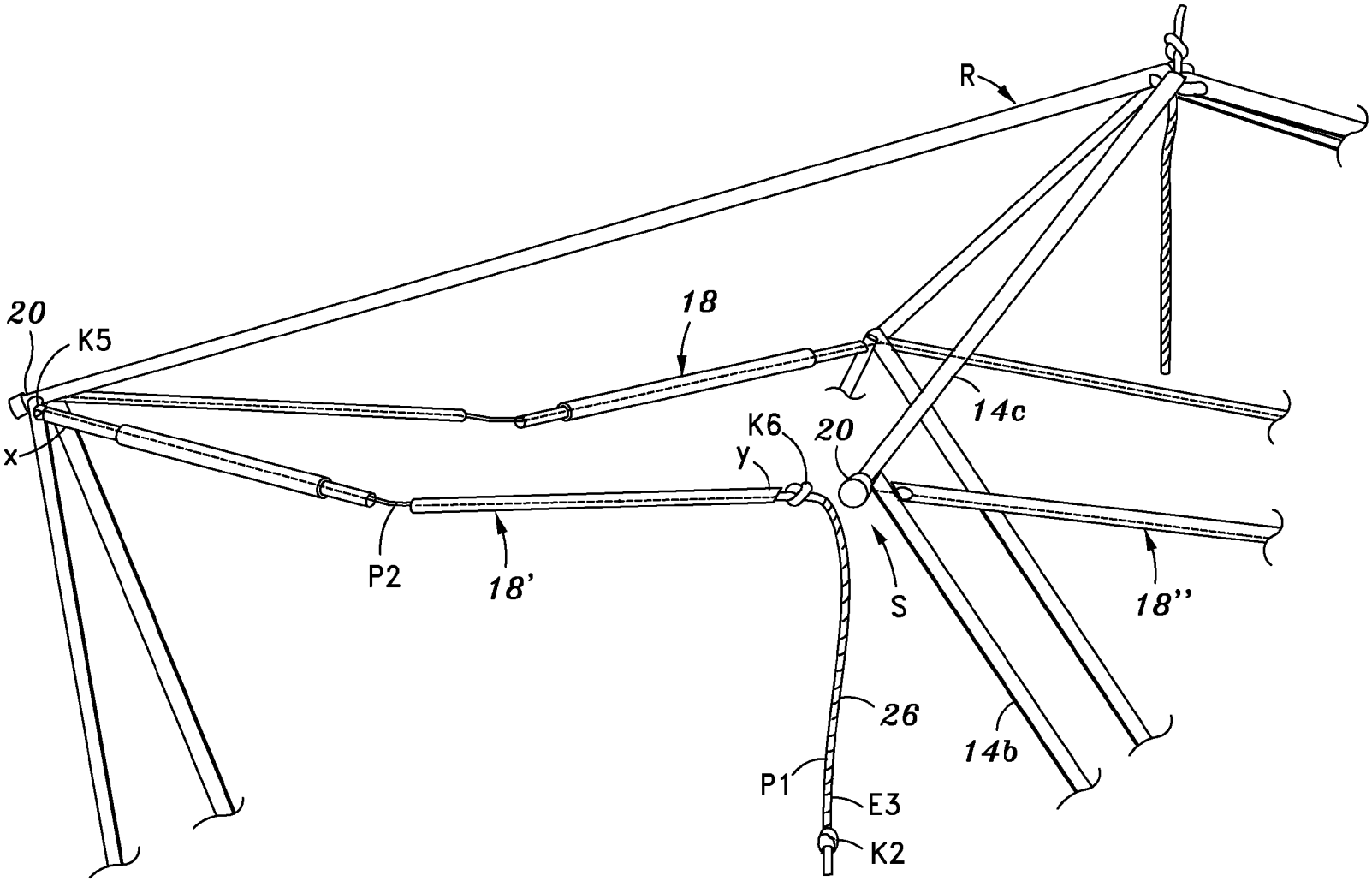
FIG. 1A is a fragmentary perspective view of the collapsible support structure shown in FIG. 1 in a partially collapsed state.

As depicted in FIG. 1A, the collapsible tubular member 18' provides a terminal end member along the junction 24 that is prevented from slipping off tensioning member 26 by a pair of knots K5 and K6. A portion P2 of the tensioning member 26 passes through the tubular member 18' and each knot K5 and K6 abuts one outer extremity X or Y of this tubular member 18', as the case may be. The knots K5 and K6 are sufficiently large to prevent the portion P2 of the tensioning member 26 passing through the tubular member 18' from moving laterally. Thus, with these knots K5 and K6 straddling the terminal end member 18' and each abutting one of the outer extremities X and Y of the terminal end member, the pair of axially aligned rigidizing tubular members 18*a* and 18*b* do not move a substantial distance laterally along the tensioning member 26 upon the collapse of the terminal end member 18' when the sleeve 18*c* is moved laterally. Consequently, all the rigidizing members 18*a* and 18*b* remain more or less in the same relative position along the tensioning member 26, but are foldable relative to each other upon moving the sleeve members 18*c* laterally. These benefits include, but are not limited to, a collapsible support structure using (a) tubular members having flexible tensioning members passing along hollow interiors of the tubular members or through ends of the tubular members to provide a simplified and low cost way to connect these tubular members into a plurality of substantially triangular frames that are interconnected at flexible, hinged, joints at corners formed by the tensioning members and (b) forming a frame roof by connecting ends of the tubular members with a flexible line to provide a flexible apex in the frame roof.

SCOPE OF THE INVENTION

The above presents a description of the best mode I contemplate of carrying out my collapsible support structure, and of the manner and process of making and using it, in such full, clear, concise, and exact terms as to enable any person skilled in the art to which it pertains to make and use my collapsible support structure. My collapsible support structure is, however, susceptible to modifications and alternate constructions from the illustrative embodiments discussed above which are fully equivalent. Consequently, it is not the intention to limit my collapsible support structure to the particular embodiments disclosed. On the contrary, my intention is to cover all modifications and alternate constructions coming within the spirit and scope of my collapsible support structure as generally expressed by the following claims, which particularly point out and distinctly claim the subject matter of my invention:

The invention claimed is:

1. A collapsible support structure comprising a plurality substantially triangular frame sections each having corners connected by flexible joints, each frame section including a first elongated rigid tubular member having opposed first and second ends and adjacent each end of the first member a pair of openings, a second elongated rigid tubular member having opposed first and second ends and adjacent each end of the second member a pair of openings, and a collapsible elongated tubular member having opposed first and second open ends, said collapsible tubular member having a rigid state and a collapsed state so the support structure is foldable when said collapsible member is collapsed, a first predetermined number of the frame sections forming a frame roof of the support structure and a second predetermined number of the frame sections forming a frame sidewall of the support structure, said sidewall having a top segment including the collapsible tubular member of each frame section forming the frame roof and a bottom segment including the collapsible tubular member of alternate frame sections forming the frame sidewall, the first ends of said first and second tubular members of the frame sections forming the frame roof being open and tied to form an apex by a flexible line passing through the pair openings and open end in each of said first ends of said first and second tubular members of the frame sections forming the frame roof to provide a flexible joint at the apex, enabling the frame roof to fold inward without untying the flexible line when said collapsible tubular members of the frame sections forming the frame roof are collapsed.

2. The collapsible support structure of claim 1 where the individual openings of each pair of openings are in substantial alignment.

3. The collapsible support structure of claim 1 including a connector member near the first open ends of the first and second tubular members forming the apex, and at each said first open end nearby the apex, the flexible line first passes through one of the openings of said pair in said open end nearby the apex, then out said open end nearby the apex and around the connector member, and then back into said open end nearby the apex and out the other opening of said pair in said open end nearby the apex.

4. The collapsible support structure of claim 3 where the connector member has a substantially annular configuration.

5. The collapsible support structure of claim 1 where the collapsible tubular members comprising the top segment are aligned from end to end and the first and second tubular members of the frame sections forming the frame roof have their respective second ends alternately disposed between adjacent pairs of said aligned collapsible tubular members comprising the top segment, and the collapsible tubular members comprising the bottom segment are aligned from end to end and the second ends of both the first and second tubular members of adjacent frame sections forming the frame sidewall are disposed between adjacent pairs of collapsible tubular members, and a first elongated flexible tensioning member passing through the aligned collapsible tubular members comprising the top segment, exiting a first open end of one of the collapsible tubular members of an adjacent pair of collapsible tubular members of the top segment and then passing through openings in the rigid tubular members disposed between said adjacent pair, and then into the second open end of the other collapsible tubular member of the adjacent pair in the top segment, and a second elongated flexible tensioning member passing through the aligned collapsible tubular members comprising the bottom segment, exiting a first open end of one of the collapsible tubular members of an adjacent pair of collapsible tubular members of the bottom segment and then passing through openings in the rigid tubular members disposed between said adjacent pair in the bottom segment, and then into the second open end of the other collapsible tubular member of the adjacent pair in the bottom segment.

6. The collapsible support structure of claim 5 where the first elongated flexible tensioning member has opposed terminal ends, one of which is permanently tied to a ring and the other end is loosened through said ring, when said collapsible tubular members forming the top segment are collapsed.

7. The collapsible support structure of claim 1 where the collapsible tubular members each include a first tubular rigidizing member extending along a portion of an elongated flexible tensioning member, a second tubular rigidizing member extending along another portion of the elongated flexible tensioning member, and a rigidizing sleeve member mounted to slide over the rigidizing members when both rigidizing members are essentially axially aligned, and said elongated rigid members and said collapsible elongated member all being hingedly joined in flexible joints by said elongated tensioning member, said flexible joints interconnecting at least some adjacent frame sections at corners thereof.

8. The collapsible support structure of claim 1 where one the collapsible tubular members provides a terminal end member, said terminal end member including a pair of axially aligned rigidizing tubular members through which extends a portion of an elongated flexible tensioning member and a slideable sleeve member positioned to slide over said rigidizing members to form the terminal end member, said elongated rigid members and said collapsible elongated members of adjacent frame sections being joined at corners thereof by said elongated tensioning member passing through the corners of said adjacent frame sections to form flexible joints at said corners, a portion of said tensioning member including a pair of knots straddling outer extremities of the terminal end member so the pair of axially aligned rigidizing tubular members do not move a substantial distance laterally along the tensioning member upon the collapse of the end member.

9. The collapsible support structure of claim 1 where the interconnected frame sections each form a portion of a geodesic structure.

10. The collapsible support structure of claim 1 where the interconnected frame sections form a portion of a truncated icosahedron.

11. The collapsible support structure of claim 1 where at least some of the ends of the rigid tubular members and the collapsible tubular members are beveled.

12. A collapsible support structure comprising a plurality of substantially triangular frame sections interconnected by flexible joints, each frame section comprising a first elongated one-piece rigid tubular member having opposed first and second ends with a pair of openings in each said end, a second elongated one-piece rigid tubular member having opposed first and second ends with a pair of openings in each said end, and a collapsible elongated tubular member having opposed open ends, and an elongated flexible tensioning member disposed within and passing through the collapsible elongated tubular member and extending outward from said opposed open ends and passing through the openings in second ends of the first and second rigid tubular members, and into and through the collapsible elongated tubular member of an adjacent frame section to tie and form the flexible joint interconnecting adjacent frame sections.

13. The collapsible support structure of claim 12 where the interconnected frame sections each form a portion of a geodesic structure.

14. The collapsible support structure of claim 12 where the interconnected frame sections form a portion of a truncated icosahedron.

15. A collapsible support structure having a configuration substantially of a truncated icosahedron and comprising a plurality of substantially triangular frame sections interconnected by flexible joints at corners thereof to form a frame roof and a frame sidewall, each frame section including a pair of rigid members each with a pair of openings in ends thereof and one collapsible elongated tubular member including opposed first and second open ends and having a rigid state and a collapsed state so the support structure is foldable when said collapsible member is collapsed, said frame roof and sidewall joined together by alternately the collapsible elongated tubular members of the frame sections forming the frame roof and the sidewall, said collapsible elongated tubular members being adjacent and aligned end to end, and disposed between ends of said adjacent collapsible members a first end of one rigid member of one frame section comprising the frame roof and a first end of one rigid member of each adjacent frame sections comprising the frame sidewall, said first end of the frame roof rigid member being disposed between the first ends of the frame sidewall rigid members, an elongated flexible tensioning member passing through the adjacent pairs of the collapsible tubular members, exiting an open end of one of the collapsible tubular members of an adjacent pair and passing through the openings formed in the ends of the rigid members disposed between said adjacent and aligned collapsible tubular members, and then into the second open end of the other collapsible tubular member of the adjacent pair to tie and form the flexible joint interconnecting adjacent frame sections.

16. A support structure having an upright state and a collapsed state and comprising a plurality of interconnected substantially triangular frame sections with adjacent frame sections connected at corners thereof to form a frame roof and a frame sidewall, each said frame section including a pair of rigid tubular members with a pair of substantially aligned openings in at least one end thereof and a collapsible tubular member, the collapsible tubular members of each frame section forming said frame roof and frame sidewall oriented from end to end and through which extends an elongated flexible tensioning member, at least some of said ends of the rigid tubular members of adjacent frame sections forming the frame roof and frame sidewall positioned between said collapsible tubular members of each frame section forming said frame roof and frame sidewall, said elongated flexible tensioning member passing through the collapsible tubular members and the openings formed in said ends of said rigid tubular members to form flexible joints and having opposed ends that are tied, one of which is permanently tied and one of which is untied and loosened when the support structure is an upright state and untied to collapse the support structure.

17. The collapsible support structure of claim 16 where one the collapsible tubular members provides a terminal end member, said terminal end member including a pair of axially aligned rigidizing tubular members through which extends a portion of the elongated flexible tensioning member and a slideable sleeve member positioned to slide over said rigidizing members to form the terminal end member, said elongated rigid members and said collapsible elongated members of adjacent frame sections being joined at corners thereof by said elongated tensioning member passing through the corners of said adjacent frame sections to form flexible joints at said corners, a portion of said tensioning member including a pair of knots straddling outer extremities of the terminal end member so the pair of axially aligned rigidizing tubular members do not move a substantial distance laterally along the tensioning member upon the collapse of the end member.

18. A collapsible support structure comprising a sidewall and a roof formed by a plurality of interconnected substantially triangular frame sections connected by flexible joints at corners thereof, each frame section forming the sidewall comprising a pair of rigid tubular members each having opposed ends and a collapsible tubular member having opposed open ends, at least some of said interconnected frame sections sharing the collapsible tubular member thereof as one side of the interconnected triangular frame sections and at least some of the ends of the rigid tubular members disposed between adjacent shared collapsible tubular members of said interconnected frame sections, said ends having therein a pair of substantially aligned openings, and an elongated flexible tensioning member extending through said shared collapsible tubular members and outward from said opposed open ends thereof and through the aligned openings and between said ends of the rigid tubular members disposed between adjacent shared collapsible tubular members of said interconnected frame sections, said rigid tubular members of the interconnected frame sections forming said roof having ends connected by a flexible line to form an apex, said line passing through the aligned openings in said ends at said apex to provide a flexible joint at the apex, enabling the frame roof to fold inward without untying the flexible line when said collapsible tubular members are collapsed.

* * * * *